US010395627B2

(12) United States Patent
Colas et al.

(10) Patent No.: US 10,395,627 B2
(45) Date of Patent: Aug. 27, 2019

(54) CAP-STYLE LOCKING STUD

(71) Applicant: ADVANCED PLATING, INC., Nashville, TN (US)

(72) Inventors: Jeremy Colas, Murfreesboro, TN (US); Steve Tracy, Gallatin, TN (US)

(73) Assignee: ADVANCED PLATING, INC., Nashville, TN (US)

( * ) Notice: Subject to any disclaimer, the term of this patent is extended or adjusted under 35 U.S.C. 154(b) by 42 days.

(21) Appl. No.: 15/412,612

(22) Filed: Jan. 23, 2017

(65) Prior Publication Data

US 2018/0033412 A1 Feb. 1, 2018

Related U.S. Application Data

(60) Provisional application No. 62/367,956, filed on Jul. 28, 2016.

(51) Int. Cl.
*G10D 3/12* (2006.01)
*G10D 3/04* (2006.01)

(52) U.S. Cl.
CPC ..... *G10D 3/12* (2013.01); *G10D 3/04* (2013.01)

(58) Field of Classification Search
CPC ..... G10D 3/04
See application file for complete search history.

(56) References Cited

U.S. PATENT DOCUMENTS

| | | | | |
|---|---|---|---|---|
| 3,437,001 | A | 4/1969 | Kraft | |
| 5,285,710 | A | 2/1994 | Chapman | |
| 5,739,444 | A | 4/1998 | Borisoff | |
| 6,613,968 | B1 | 9/2003 | Devereaux et al. | |
| 6,686,523 | B1 * | 2/2004 | Devereaux | G10D 3/04 84/290 |
| 2006/0162528 | A1 | 7/2006 | Kinoshita | |
| 2009/0314152 | A1 | 12/2009 | Shamblin | |
| 2010/0005944 | A1 | 1/2010 | Eliasson | |
| 2013/0055876 | A1 | 3/2013 | Mason | |

FOREIGN PATENT DOCUMENTS

DE 020309710 U1 * 10/2003 ..... F16B 23/0007

* cited by examiner

*Primary Examiner* — Kimberly R Lockett
(74) *Attorney, Agent, or Firm* — Greenblum & Bernstein, P.L.C.

(57) ABSTRACT

A component mounting stud assembly including a lower portion having an upper externally-threaded portion and a socket, an upper cap portion having an internally-threaded portion configured for engagement with the upper externally-threaded portion, and a through-hole structured and arranged to provide access through the upper cap portion to the socket when the upper cap portion is attached to the lower portion.

20 Claims, 10 Drawing Sheets

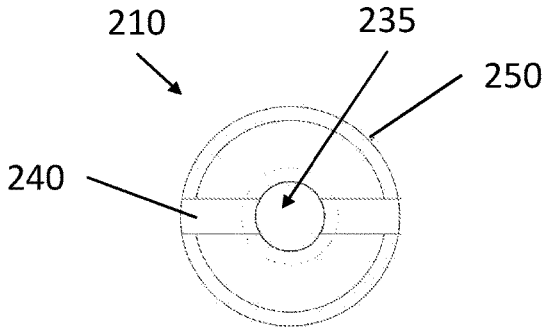
FIG. 7C
FIG. 7A
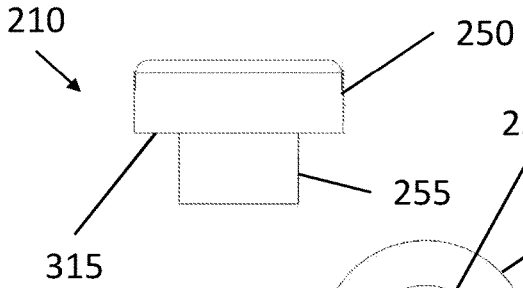
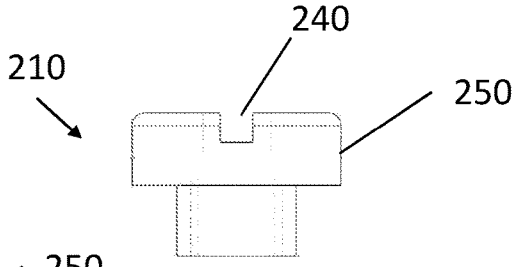
FIG. 7D
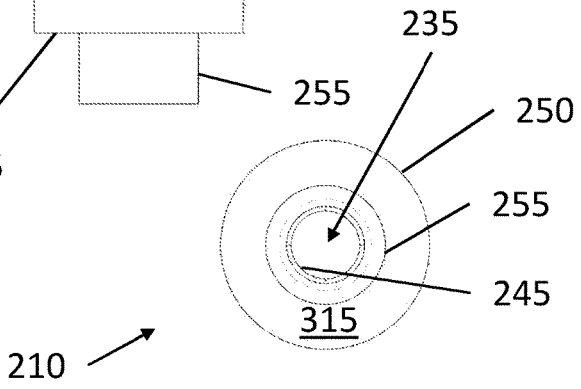
FIG. 7B

CAP-STYLE LOCKING STUD

CROSS REFERENCE TO RELATED APPLICATION

The present application claims the benefit of U.S. Provisional Application No. 62/367,956, filed Jul. 28, 2016, the contents of which are expressly incorporated herein by reference in its entirety.

BACKGROUND OF THE DISCLOSURE

1. Field of the Disclosure

This disclosure relates to stringed instruments, and more particularly to a locking stud mounting apparatus for a stringed instrument (e.g., guitar) tailpiece (or bridge).

2. Description of the Related Art

A tailpiece is a component on many stringed musical instruments that anchors one end of the strings that pass over a bridge, usually opposite the end with the tuning mechanism (e.g., the headstock). The tailpiece anchors the strings, so the tailpiece should be strong enough to withstand the combined tension of the strings. The bridge and tailpiece, while serving separate purposes, work closely together to affect playing style and tone.

A hard-tail guitar bridge has tailpiece that anchors the strings at or directly behind the bridge, and the tailpiece is fastened securely to the top of the instrument. The tailpiece is mounted to the guitar using two tailpiece studs, which each comprises a lower portion and an upper cap portion. The lower portion of the tailpiece studs are mounted to the guitar body, and each has a support platform configured to support respective sides of the tailpiece. The upper cap portion threadedly engages with the lower portion to secure the upper cap to the lower portion while pinching the tailpiece to securely fasten the tailpiece to the guitar.

Each tailpiece stud lower portion includes a height adjusting mechanism to adjust the heights of the respective studs (and the support platforms) so that a user may, for example, adjust the height of the tailpiece. For example, due to the stud's threaded engagement with the guitar body (or with a grommet on the body of the guitar), rotating the stud brings about a change in the stud height.

U.S. Pat. No. 6,686,523 teaches a conventional tailpiece stud (or insert). As explained in this document, the mounting stud (or mounting apparatus) comprises a top portion and a threaded lower portion. The component (or tailpiece) is positioned such that the component is supported on a plate of the insert. The mounting stud (or top portion) is fastened into an aperture portion of the insert (of the lower portion) such that the top portion of the mounting stud clamps down on the component and securely holds the component in place.

As further explained in U.S. Pat. No. 6,686,523, the mounting apparatus comprises a mounting stud and an insert. The insert further includes a threaded bottom portion, an aperture portion, and a plate located between the threaded bottom portion and the aperture portion. The plate is preferably squared off to accept a wrench or is knurled to provide a gripping surface. The insert is removably mounted into the instrument body by fastening the threaded bottom portion into a threaded hole or grommet on the body of the guitar. Thus, the height of the mounting apparatus and, consequently, the component arranged on the mounting apparatus may be adjusted by rotating the insert up or down via the plate relative to the instrument body.

With conventional tailpiece studs, however, such a height adjustment is difficult to accomplish and/or requires a separate tool (e.g., a wrench) to accomplish. That is, with some conventional tailpiece studs, the support platform (or plate) includes a knurled outer surface, wherein height adjustment is accomplished by the user grasping the knurled outer surface and rotating the stud, which may be difficult with strings already mounted the guitar and in tension. With other conventional tailpiece studs, the support platform may be squared off to accept a wrench for adjusting the platform height, which requires a separate wrench to make such height adjustments. In order to rotate the stud, the support platform (or plate) of the stud is accessed from the side of the stud, which may be difficult. Moreover, when the tailpiece is mounted to the studs, for example, the area in which the wrench must access is further limited and using a wrench (e.g., a crescent wrench) to rotate the stud is even more difficult and may inadvertently damage the guitar e.g., a finish on the body of the guitar or the metal components of the studs and/or tailpiece.

Therefore, there is a need for an improved mounting stud for a tailpiece that solves these above-noted deficiencies, provides improved performance and improved usability.

SUMMARY OF THE EMBODIMENTS OF THE DISCLOSURE

Aspects of the present disclosure are directed to a component mounting stud assembly, comprising a lower portion having an upper externally-threaded portion and a socket, an upper cap portion having an internally-threaded portion configured for engagement with the upper externally-threaded portion, and a through-hole structured and arranged to provide access through the upper cap portion to the socket when the upper cap portion is attached to the lower portion.

In embodiments, the lower portion further comprises a lower threaded portion configured for threaded engagement with a stringed instrument.

In further embodiments, the lower portion further comprises a support platform configured for supporting a component.

In some embodiments, the component comprises a tailpiece.

In yet further embodiments, the component comprises a bridge assembly.

In certain embodiments, the lower portion further comprises a lower receiving shaft arranged between the support platform and the upper externally-threaded portion.

In further embodiments, the upper cap portion further comprises an upper receiving shaft and a head, wherein the through-hole passes through the upper receiving shaft and the head.

In some embodiments, the upper cap portion further comprises a slot structured and arranged for receiving a slotted adjustment tool.

In yet further embodiments, the upper cap portion and the lower portion are operable to secure an end of a component between respective surfaces of the upper cap portion and the lower portion.

In embodiments, a longitudinal axis of the through-hole is along a longitudinal axis of the component mounting stud assembly.

In further embodiments, the lower portion further comprises a lower receiving shaft, and the upper cap portion further comprises an upper receiving shaft, the lower receiving shaft and the upper receiving shaft have an approximately equal diameter, and the lower receiving shaft and the upper receiving shaft together form a securing region for a component.

In some embodiments, the lower portion further comprises a support platform having a support surface configured for supporting a component, and the upper cap portion further comprises a head having a lower surface configured to contact the component when the upper cap portion is attached to the lower portion, so as to securely attach the component to the component mounting stud assembly.

In yet further embodiments, the lower portion is configured for threaded engagement with a stringed instrument, and wherein the upper cap portion and the lower portion are configured to pinch a stringed-instrument component there between such that the component is securely fastenable to the stringed instrument.

Aspects of the disclosure are also directed to a tailpiece assembly, comprising a tailpiece having a mounting slot or hole at respective longitudinal end regions of the tailpiece, and a component mounting stud assembly secured to each mounting slot or hole Further aspects of the disclosure are directed to a stringed instrument, comprising two instrument mounting holes and a tailpiece assembly, wherein the respective lower portions further comprise a lower threaded portion configured for respective threaded engagement with the two instrument mounting holes Aspects of the disclosure are also directed to a bridge assembly, comprising a bridge having a mounting hole at respective longitudinal end regions of the bridge a component mounting stud assembly secured to each mounting hole.

Further aspects of the disclosure are directed to a stringed instrument, comprising two instrument mounting holes, and a bridge assembly, wherein the respective lower portions further comprise a lower threaded portion configured for respective threaded engagement with the two instrument mounting holes.

Additional aspects of the present disclosure are directed to a method of adjusting a component mounting stud assembly, the stud assembly comprising a lower portion having an upper externally-threaded portion and a socket, an upper cap portion having an internally-threaded portion configured for engagement with the upper externally-threaded portion, and a through-hole structured and arranged to provide access through the upper cap portion to the socket when the upper cap portion is attached to the lower portion. The method comprises passing an adjustment tool through the through-hole of the upper cap portion and into engagement with the socket of the lower portion, and rotating the adjustment tool to rotate the lower portion so as to adjust a height of the component mounting stud assembly.

Further aspects of the present disclosure are directed to a component mounting stud assembly, comprising a lower portion having an upper externally-threaded portion, a socket, a lower threaded portion configured for threaded engagement with a stringed instrument, a support platform configured for supporting a component, and a lower receiving shaft arranged between the support platform and the upper externally-threaded portion. The component mounting stud assembly further comprises an upper cap portion having an internally-threaded portion configured for engagement with the upper externally-threaded portion, a through-hole structured and arranged to provide access through the upper cap portion to the socket when the upper cap portion is attached to the lower portion, an upper receiving shaft, and a head. The through-hole passes through the upper receiving shaft and the head. A longitudinal axis of the through-hole is along a longitudinal axis of the component mounting stud assembly. The lower receiving shaft and the upper receiving shaft together form a securing region for a component. The upper cap portion and the lower portion are operable to secure an end of the component between respective surfaces of the upper cap portion and the lower portion.

In embodiments, the component comprises a tailpiece or a bridge assembly.

BRIEF DESCRIPTION OF THE DRAWINGS

The novel features which are characteristic of the systems, both as to structure and method of operation thereof, together with further aims and advantages thereof, will be understood from the following description, considered in connection with the accompanying drawings, in which embodiments of the system are illustrated by way of example. It is to be expressly understood, however, that the drawings are for the purpose of illustration and description only, and they are not intended as a definition of the limits of the system. For a more complete understanding of the disclosure, as well as other aims and further features thereof, reference may be had to the following detailed description of the embodiments of the disclosure in conjunction with the following exemplary and non-limiting drawings wherein:

FIGS. 7A-7D show various views of the upper cap portion of the stud assembly in accordance with aspects of the present disclosure;

Figure 1:
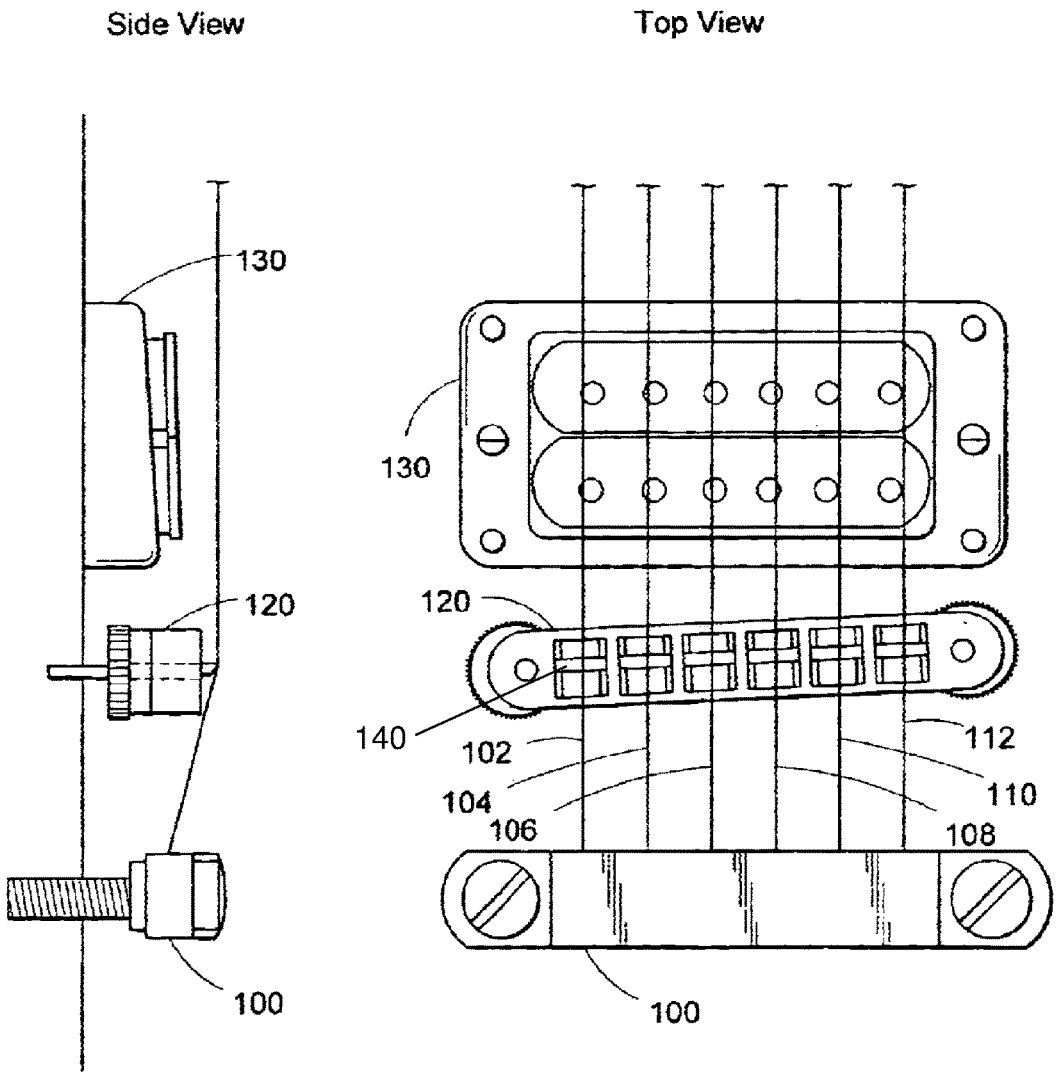
FIG. 1 (Prior Art)
FIG. 1 is a top and side view of a conventional guitar upon which a guitar bridge is mounted.

Reference numbers refer to the same or equivalent parts of the present disclosure throughout the various figures of the drawings.

DETAILED DESCRIPTION OF THE EMBODIMENTS OF THE DISCLOSURE

In the following description, the various embodiments of the present disclosure will be described with respect to the enclosed drawings. As required, detailed embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, or any other value or range within the range.

As used herein, the indefinite article "a" indicates one as well as more than one and does not necessarily limit its referent noun to the singular.

As used herein, the terms "about" and "approximately" indicate that the amount or value in question may be the specific value designated or some other value in its neighborhood. Generally, the terms "about" and "approximately" denoting a certain value is intended to denote a range within ±5% of the value. As one example, the phrase "about 100" denotes a range of 100±5, i.e. the range from 95 to 105. Generally, when the terms "about" and "approximately" are used, it can be expected that similar results or effects according to the disclosure can be obtained within a range of ±5% of the indicated value.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. The term "parallel" refers to deviating less than 5° from mathematically exact parallel alignment. Similarly "perpendicular" refers to deviating less than 5° from mathematically exact perpendicular alignment.

The term "at least partially" is intended to denote that the following property is fulfilled to a certain extent or completely.

The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for instance a composition comprising a compound A may include other compounds besides A. However, the term "comprising" also covers the more restrictive meanings of "consisting essentially of" and "consisting of", so that for instance "a composition comprising a compound A" may also (essentially) consist of the compound A.

The various embodiments disclosed herein can be used separately and in various combinations unless specifically stated to the contrary.

The present disclosure also provides for improving the sound from the guitar by creating a more solidly mounted system for coupling the strings to a resonating guitar body. The solid connection afforded by the disclosed embodiments allows for the guitar instrument to resonate better, thus transferring the sound to the instrument body and enhancing the played notes. The sound quality is also enhanced due to the solid adjustment of the tailpiece (and/or bridge) components allowing for increased harmonic overtone transfer to the instrument pickups.

FIG. 1 is a top and side view of a conventional guitar upon which a guitar bridge and tailpiece is mounted. As shown in FIG. 1, with this exemplary embodiment, a tailpiece 100 is mounted on a body of an exemplary 6-string guitar and holds one end of strings 102, 104, 106, 108, 110, and 112. With this arrangement, the tailpiece 100 provides the mechanical strength for the tension of the stretched strings against the body of the guitar. These strings 102, 104, 106, 108, 110, and 112 then pass over a bridge 120, which is used to initially set the tuning of the guitar so the guitar plays in tune with the proper tone and timbre. The bridge 120 includes a number of saddles (e.g., one or two for each string), wherein each string passes (or two strings pass) over a respective saddle. Each saddle may be similarly constructed and may include one or more notches, through which the string passes to hold its respective string above the bridge and guitar at a desired height. Alternatively, in embodiments, the saddles may have no notches at all. The position of each saddle (within the bridge) along the length of the guitar (i.e., in a string extension direction) may be altered to adjust the intonation of each string.

As shown in FIG. 1, in an electric guitar, the strings 102, 104, 106, 108, 110, and 112 also pass over one or more magnetic or other types of pickups 130. The pickups 130 are used to convert the physical vibrations of the strings 102, 104, 106, 108, 110, and 112 into electrical signals that can then be electrically amplified.

The strings 102, 104, 106, 108, 110, and 112 then extend over, but do not contact, multiple frets (not shown) on the guitar. Towards a neck of the guitar, the strings 102, 104, 106, 108, 110, and 112 then pass over a nut (not shown) to tuning pegs (not shown). The tuning pegs are adjustable to increase or decrease the tension of each respective string 102, 104, 106, 108, 110, and 112, which raises or lowers the frequency of the tone of each string so that the proper notes are heard upon plucking or strumming the guitar. Between the nut and the bridge 120 are the various frets between which the strings 102, 104, 106, 108, 110, and 112 are depressed so that the effective length of the string is shortened to thereby increase the frequency at which that particular string vibrates.

An important factor in a quality electric guitar is the guitar sound. The material of the body, the quality of the magnetic or other pickups (e.g., piezo pickups), the rigidity of the guitar itself, the accuracy of the placement and spacing of the strings 102, 104, 106, 108, 110, and 112 above the fingerboard and associated frets, the actual placement of the frets, and the quality of the tuning bridge 120 and tailpiece 100 are all important to the overall sound of the guitar.

The strings 102, 104, 106, 108, 110, and 112 are stretched initially between the bridge 120 and the nut (not shown) just to tune the strings 102, 104, 106, 108, 110, and 112 to their proper respective note. Then the strings 102, 104, 106, 108, 110, and 112 are stressed further by a guitar player, upon playing, by forcing the strings 102, 104, 106, 108, 110, and 112 down onto the fingerboard between frets.

Figure 2A:
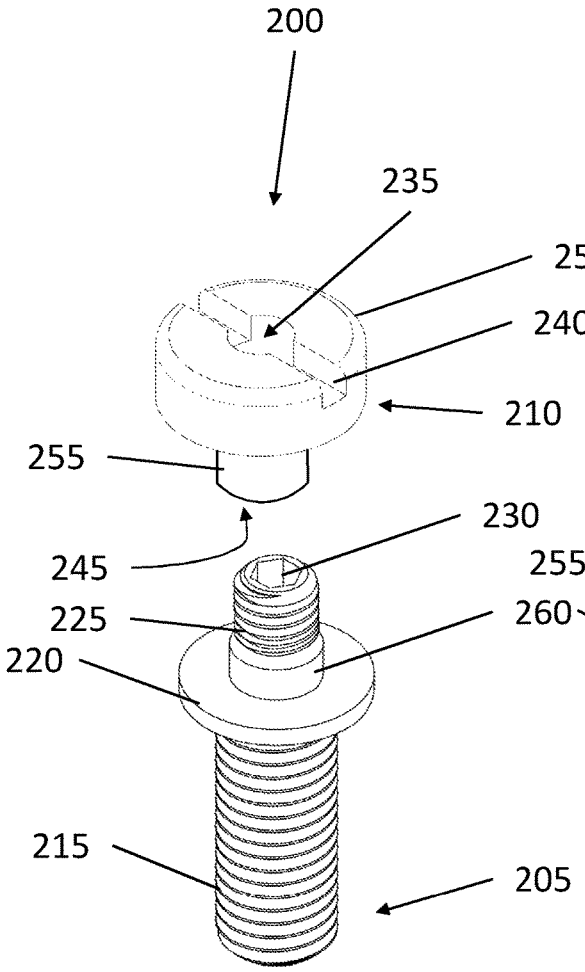
FIGS. 2A and 2B show perspective views of a tailpiece stud assembly in accordance with aspects of the disclosure.
Figure 2B:
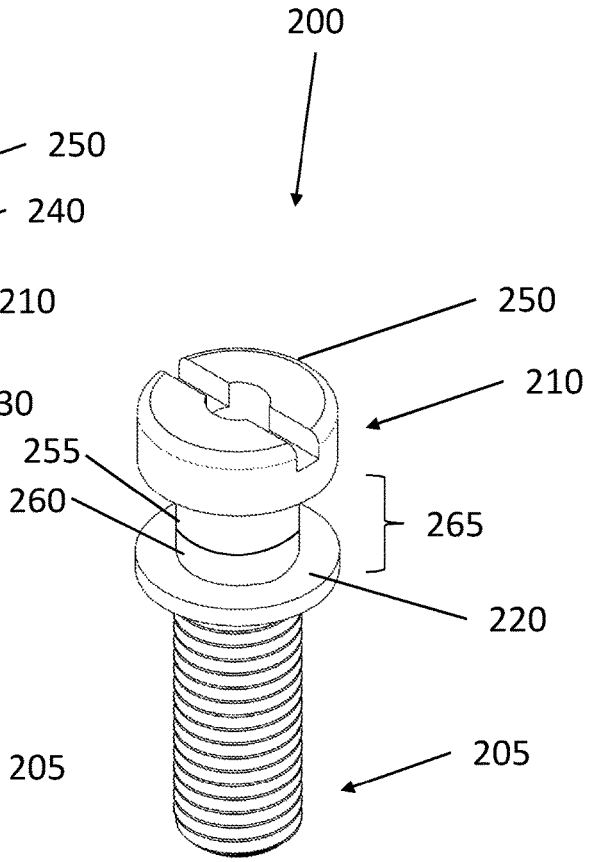

FIGS. 2A and 2B show perspective views of a tailpiece stud assembly 200 in accordance with aspects of the disclosure. As shown in the exploded view of FIG. 2A, the tailpiece stud assembly 200 includes a lower portion 205 and an upper cap portion 210. As shown in the assembled view of FIG. 2B, the lower portion 205 and the upper cap portion 210 are fastenable to one another to form the tailpiece stud assembly 200.

The lower portion 205 includes a lower threaded portion 215 configured to be threaded into the body of a musical instrument (e.g., guitar), for example directly or via a grommet. The lower portion 205 also includes a support platform 220 that is structured and arranged to support an end of a tailpiece thereon. The lower portion 205 also includes a lower receiving shaft 260 and an upper threaded portion 225 extending from the lower receiving shaft 260. The upper threaded portion 225 has external threads structured and arranged for threaded engagement with a corresponding female internally threaded portion 245 (see also, FIG. 7B) of the upper portion 210.

As shown in FIG. 2, the lower portion 205 also includes a socket 230 (e.g., a hex socket). In accordance with aspects of the disclosure, the socket 230 may be used to rotate (e.g., using a hex wrench or Allen wrench) the lower portion 205 so as to adjust the height of the lower portion (or an extent of the threaded engagement of the lower portion 205 with the guitar). That is, instead of rotating the lower portion 205 by contacting an external surface of the support platform, with embodiments of the present disclosure, the lower portion 205 is rotatable by engaging a tool with an internal surface (e.g., the socket 230) of the lower portion. Thus, by implementing this aspect of the disclosure, a user can fasten the lower portion 205 to the guitar body without needing to contact (e.g., with a tool) the external surfaces of the lower portion 205 of the stud assembly 200. As such, damage to the lower portion 205 (e.g., to the surface or finish) can be avoided when initially installing the lower portion 205 to the instrument body.

As further shown in FIG. 2A, the upper cap portion 210 includes an upper receiving shaft 255 and a head 250. As shown in FIG. 2A, the shaft 255 includes the internally threaded portion 245 that is engagable with the upper threaded portion 225. In accordance with aspects of the disclosure, the head 250 of the upper cap portion 210 includes a through-hole 235 and a slot 240. The slot 240 is configured to receive a tool (e.g., screwdriver) to rotatably engage (e.g., tighten or loosen) the upper cap portion 210 to the upper threaded portion 225 of the lower portion 205. When the upper cap portion 210 is fastened to the lower portion 205, the upper cap portion 210 is operable to secure an end of a tailpiece (not shown) arranged on the support platform 220 to the instrument by pinching the end of the tailpiece between the support platform 220 and the head 250 of the upper cap portion 210.

In accordance with further aspects of the disclosure, when the upper cap portion 210 is fastened to the lower portion 205, the through-hole 235 allows access through the upper cap portion 210 to the socket 230 of the lower portion. Accordingly, even when the upper cap portion 210 is fastened to the lower portion 205, the socket 230 is accessible so as to allow a user to make height adjustments to the lower portion 205 (and thus, height adjustments to the stud assembly 200 and the tailpiece (not shown) arranged thereon. Accordingly, by implementing aspects of the disclosure, adjustments to the height of the tailpiece may be made without risking damage to external surfaces of the tailpiece or the stud assembly 200. Moreover, as access to the height adjustment with the embodiments of the present disclosure is via the top of the stud assembly, arranging a tool to make such adjustments is much easier than with conventional approaches that require access from a side of the stud.

Furthermore, a stringed musical instrument may have other adjustable components (e.g., bridge) with different adjustable parameters (e.g., height of bridge, saddle position adjustments for intonation) with corresponding tool sockets (e.g., hex sockets). As such, many of these adjustments to the tailpiece, for example, are made using a hex wrench (e.g., a commonly-sized hex wrench). In accordance with aspects of the disclosure, by utilizing a stud assembly that is also adjustable using a hex wrench (e.g., a commonly-sized hex wrench), the number of different tools necessary for making these adjustments to the instrument (e.g., to the tailpiece and/or the bridge) may be reduced.

As shown in the assembled view of FIG. 2B, the lower portion 205 and an upper cap portion 210 are fastenable to one another to form the tailpiece stud assembly 200. In accordance with aspects of the disclosure, when fastened to one another, a securing region 265 is formed along the lower receiving shaft 260 and the upper receiving shaft 255 between the support platform 220 of the lower portion 205 and the head 250 of the upper cap portion 210. The height of the securing region 265 may be structured so as to correspond with an approximate height of the tailpiece (not shown), so that a tightening of the upper cap portion 210 to the lower portion 205 "pinches" the tailpiece, thus securing the tailpiece to the stud assembly 200. Additionally, the outer diameters of the lower receiving shaft 260 and the upper receiving shaft 255 are approximately equal to one another, and correspond with an internal diameter of a slot or hole on the tailpiece so as to minimize any longitudinal and/or lateral movement of the tailpiece attached to the respective stud assemblies in accordance with aspects of the disclosure.

Additional string support systems are discussed in commonly-assigned U.S. application Ser. No. 15/412,640, entitled "Locking Bridge Assemebly," filed in the USPTO on even date herewith, the content of which is expressly incorporated by reference herein in its entirety.

Figure 3A:
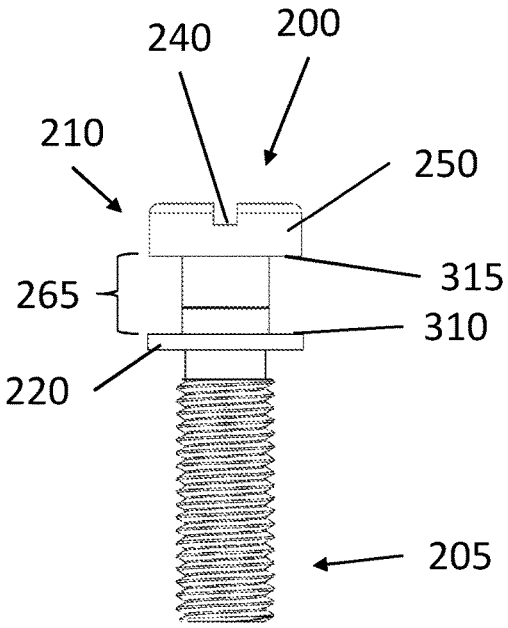
FIGS. 3A-3C respectively show exemplary side views and a top view of a tailpiece stud assembly in accordance with aspects of the disclosure.
Figure 3B:
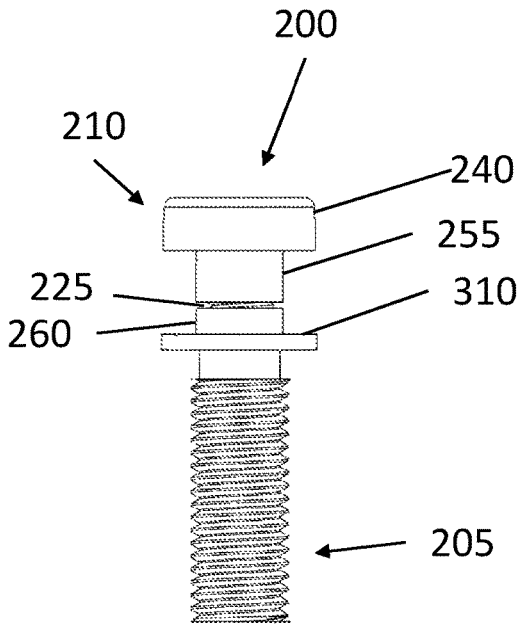
Figure 3C:
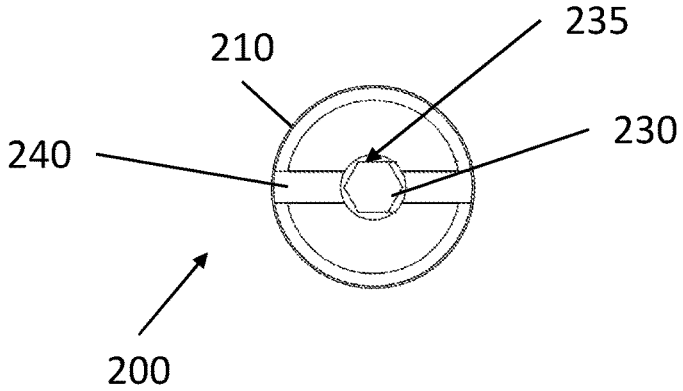

FIGS. 3A-3C respectively show exemplary side views and a top view of a tailpiece stud assembly 200 in accordance with aspects of the disclosure. As shown in FIG. 3A, when assembled, the tailpiece stud assembly 200 provides a securing region 265 for an end of a tailpiece (not shown) formed of the lower receiving shaft 260 and the upper receiving shaft 255, which have a common outer diameter. Each end of the tailpiece is secured to respective tailpiece stud assemblies 200 by being pinched between an upper surface 310 of the support platform 220 and a lower surface 315 of the head 250 of the upper cap portion 210.

As shown in FIG. 3B, the upper cap portion 210 can be rotated (e.g. using the slot 240) relative to the lower portion 205 to remove the upper cap portion 210 therefrom and/or to adjust a height of the securing region 265. For example, different tailpieces may have different heights, and the tailpiece stud assembly 200 is adjustable so as to accommodate a range of different tailpiece heights in accordance with aspects of the disclosure.

FIG. 3C shows a top view of the tailpiece stud assembly 200. As shown in FIG. 3C, the upper cap portion 210 includes a through-hole 235 therein, which provides a user access through the upper cap portion 210 to the socket 230 of the lower portion 205. Accordingly, as noted above, even when the upper cap portion 210 is fastened to the lower portion 205, the socket 230 is accessible so as to allow a user to make height adjustments to the lower portion 205 (and thus, height adjustments to the stud assembly 200 and the tailpiece (not shown) arranged thereon). Accordingly, by implementing aspects of the disclosure, adjustments to the height of the tailpiece may be made without risking damage to external surfaces of the tailpiece or the stud assembly 200. Moreover, as access to the height adjustment with the embodiments of the present disclosure is via the top of the stud assembly as shown in FIG. 3, arranging a tool to make such adjustments is much easier than with conventional approaches that require access from a side of the stud to an external surface of the support platform. FIG. 3C also shows the slot 240, which is configured to receive a tool (e.g., screwdriver or a coin) to rotatably engage (e.g., tighten or loosen) the upper cap portion 210 to the upper threaded portion 225.

Figure 4A:
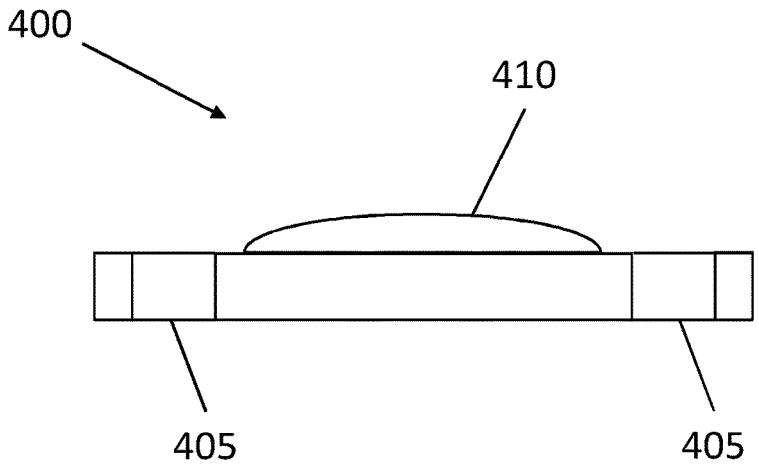
FIG. 4A shows an exemplary schematic depiction of a tailpiece.
Figure 4B:
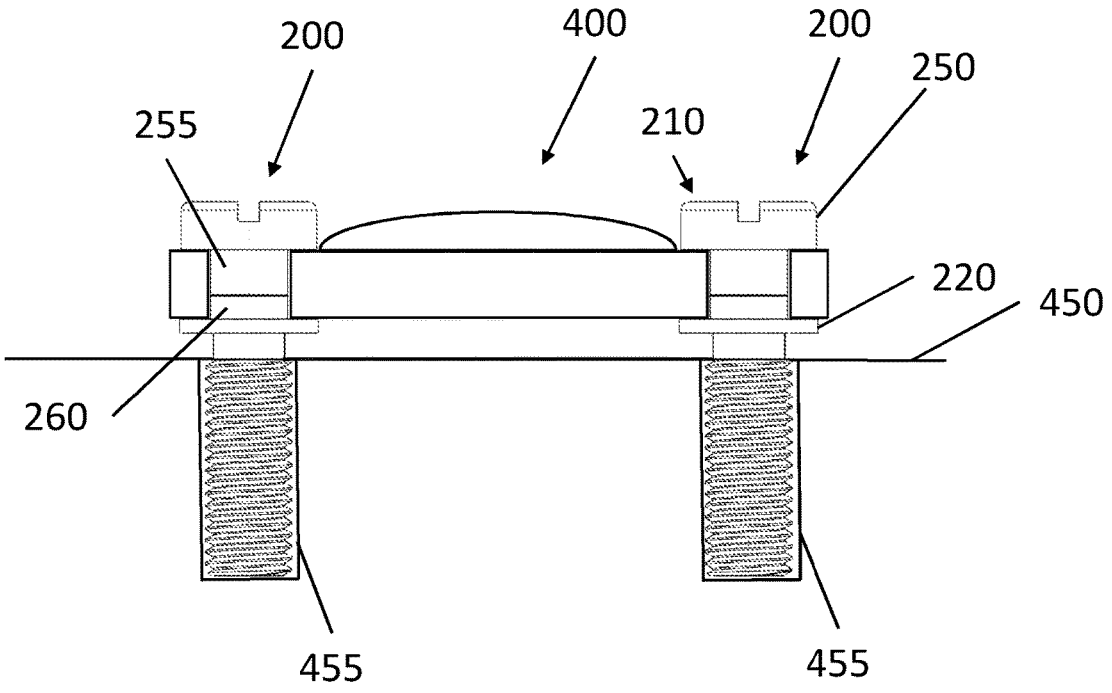
FIG. 4B shows an exemplary schematic depiction of the tailpiece mounted to a stringed-instrument body using two tailpiece stud assemblies in accordance with aspects of the disclosure.

FIG. 4A shows an exemplary schematic depiction of a tailpiece 400 and FIG. 4B shows an exemplary schematic depiction of the tailpiece 400 mounted to a stringed-instrument body 450 using two tailpiece stud assemblies 200 in accordance with aspects of the disclosure. As shown in FIG. 4A, the tailpiece 400 includes mounting slots (or holes) 405, which structured and arranged to receive the securing region 265 formed of the lower receiving shaft 260 and the upper receiving shaft 255. Additionally, the exemplary tailpiece 400 includes a string support 410 (schematically depicted), which is structured and arranged to support the strings thereon for fastening to the tailpiece 400. For example, in embodiments, one end of the respective strings may wrap around the string support 410 so as to be secured to the string support 410. In further exemplary embodiments, the string support 410 may include holes (e.g., six holes, not shown) for receiving ends of respective strings so as to be secured to the string support 410.

As shown in FIG. 4B, the tailpiece 400 is mounted to the stringed-instrument body 450 using two tailpiece stud assemblies 200. The ends of the tailpiece 400 are supported on respective securing regions 265 formed of the lower receiving shaft 260 and the upper receiving shaft 255 of respective stud assemblies 200. Moreover, the ends of the tailpiece 400 are secured to the respective stud assemblies 200 by being pinched between the upper surface (not shown) of the support platform 220 and a lower surface (not shown) of the head 250 of the upper cap portion 210. As also shown in FIG. 4B, in embodiments, the threaded lower portion 215 of the stud assembly 200 may be threadedly engaged with a grommet 455, which is secured (e.g., using a press fit, threads, and/or adhesive) to the stringed-instrument body 450.

Figure 5A:
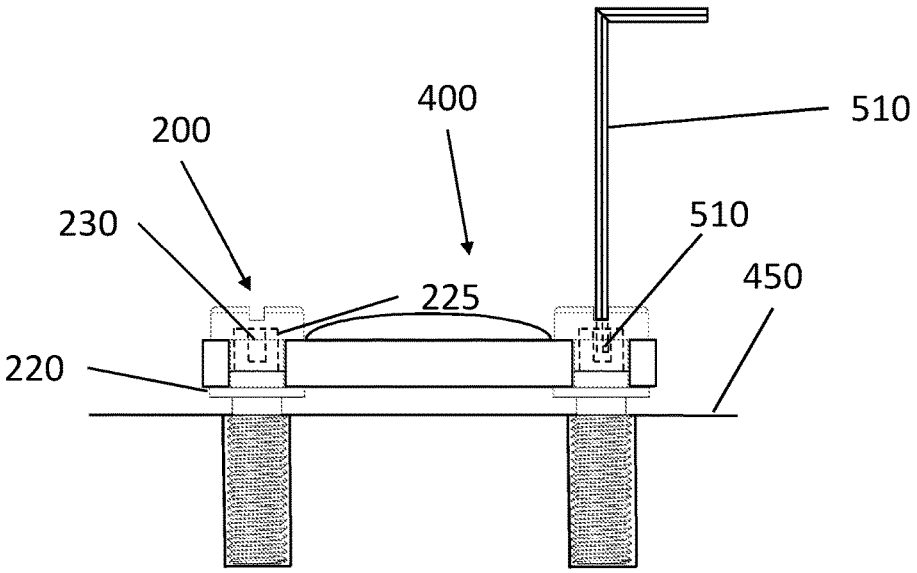
FIG. 5A shows an adjustment tool inserted from the top via the through hole of the upper cap portion into a socket of the lower portion of the stud assembly in accordance with aspects of the present disclosure.

FIG. 5A shows an adjustment tool 510 inserted from the top through the through-hole of the upper cap portion 210 into a socket 230 of the lower portion 205 of the stud assembly 200 in accordance with aspects of the present disclosure. As shown in FIG. 5A, when the adjustment tool 510 (e.g., a hex wrench or Allen wrench) is inserted from the top into a socket 230 of the stud assembly 200, the adjustment tool 510 while engaged with the socket 230, does not contact any external surfaces of the stud assembly 200. Moreover, as shown in FIG. 5A, when rotating the adjustment tool 510, for example, to adjust a height of a stud assembly 200 relative to the stringed-instrument body 450, the adjustment tool 510 poses little risk of damaging other components of the instrument (e.g., the stringed-instrument body 450 itself, the tailpiece 400, and/or elements of the stud assemblies 200). Moreover, as shown in FIG. 5A, as adjustments to the height of the stud assembly 200 are made from the top of the stud assembly 200, such adjustments may be easily made while the tailpiece 400 is secured thereto.

Figure 5B:
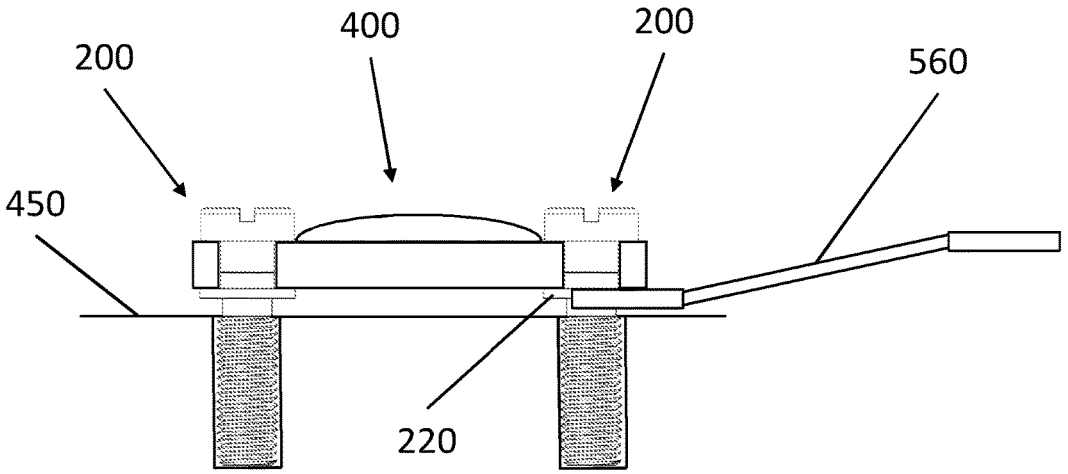
FIG. 5B shows a wrench adjustment tool arranged on a side of the stud assembly in engagement with an outer surface of the support platform.

In contrast, FIG. 5B shows a wrench adjustment tool 560 arranged on a side of the stud assembly 200 in engagement with an outer surface of the support platform 220. As shown in FIG. 5B, with such an arrangement, in order to adjust the height of the stud (with the tailpiece attached), the wrench 560 must be positioned between the stringed-instrument body 450 and the tailpiece 400. As can be observed in FIG. 5B, such a positioning of the wrench 560 may be difficult due to the relatively small space in which the wrench 560 is arrangable. Moreover, due to the required positioning of the wrench 560, when inserting wrench 560 and/or when applying torque to the wrench 560 to rotate the stud assembly 200, the wrench 560 may cause damage to the instrument (e.g., the stringed-instrument body 450 itself, the tailpiece 400, and/or elements of the stud assemblies 200). As such, in accordance with aspects of the disclosure, by providing a through-hole 235 and an adjustment socket 230, which is accessible from the top of the stringed instrument via the through-hole 235, damage to the instrument may be avoided or mitigated when making adjustments to the height of the stud assembly 200 (and when initially installing the stud assemblies 200 on the instrument body). While embodiments of the present disclosure include an adjustment socket 230 for adjusting the height of the stud assembly 200, the disclosure contemplates the support platform 220 may also include an outer surface that is knurled and/or configured for receiving an adjustment tool (e.g., a wrench).

Figure 6C:
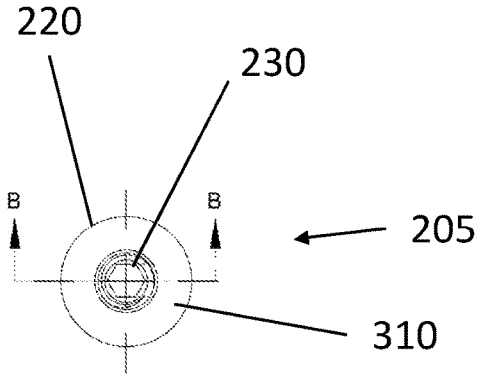
FIGS. 6A-6C show various views of the lower portion of the stud assembly in accordance with aspects of the present disclosure.
Figure 6A:
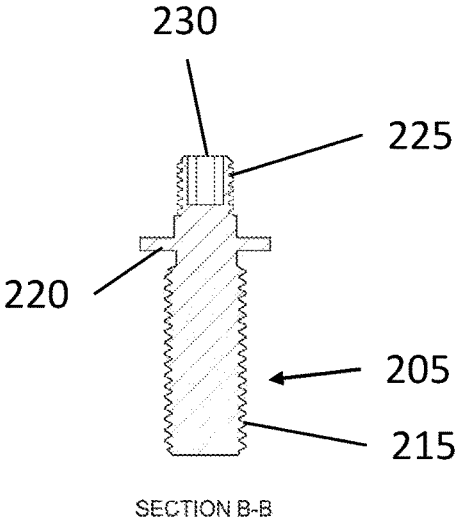
Figure 6B:
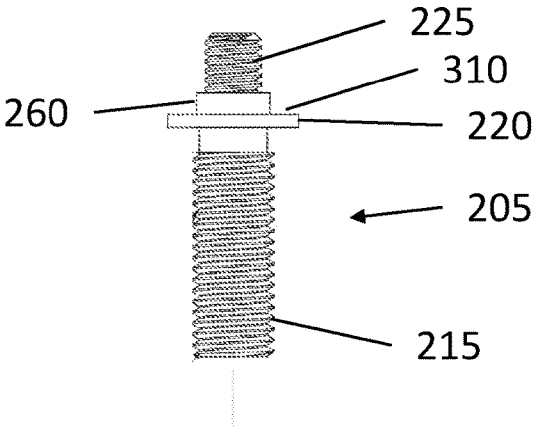

FIGS. 6A-6C show various views of the lower portion 205 of the stud assembly in accordance with aspects of the present disclosure, wherein FIG. 6A shows a sectional view of the lower portion 205, FIG. 6B shows a side view of the lower portion 205, and FIG. 6C shows a top view of the lower portion 205.

As shown in FIG. 6A, the lower portion 205 includes a lower threaded portion 215 and an upper threaded portion 225. The lower portion 205 also includes a support platform 220. Additionally, in accordance with aspects of the disclosure, the lower portion 205 includes socket 230 structured and arranged for receiving a tool for rotating the lower portion 205, so as to initially connect the lower portion 205 to a stringed-instrument body (e.g., guitar) and/or to adjust (e.g., raise or lower) a height of the lower portion 205 relative to the stringed-instrument body.

FIG. 6B shows a side view of the lower portion 205 in accordance with aspects of the disclosure. As shown in FIG. 6B, the lower receiving shaft 260 is formed between the upper surface 310 of the support platform 220 and the upper threaded portion 225. The lower receiving shaft 260 is sized to receive a portion of the slot or receiving hole of the tailpiece (not shown), and the support platform 220 is sized to support a portion of the tailpiece on the upper surface 310 thereof.

FIG. 6C shows a top view of the lower portion 205 in accordance with aspects of the disclosure. As shown in FIG. 6C, the lower portion 205 includes a socket 230 structured and arranged for receiving a tool for rotating the lower portion 205. Additionally, as shown in FIG. 6C, the support platform 220 provides a supporting upper surface 310 for a portion of the tailpiece (not shown) arranged thereon.

FIGS. 7A-7D show various views of the upper cap portion 210 of the stud assembly in accordance with aspects of the present disclosure, wherein FIG. 7A shows a side view of the upper cap portion 210, FIG. 7B shows a bottom view of the upper cap portion 210, FIG. 7C shows a top view of the upper cap portion 210, and FIG. 7D shows a further side view of the upper cap portion 210.

As shown in FIG. 7A, the upper cap portion 210 includes a head 250 and an upper receiving shaft 255. Additionally, the head 250 of the upper cap portion 210 includes a lower surface 315. The upper receiving shaft 255 is sized to receive a portion of the slot or receiving hole of the tailpiece (not shown).

FIG. 7B shows a bottom view of the upper cap portion 210 in accordance with aspects of the present disclosure. As shown in FIG. 7B, the upper cap portion 210 includes internal threads 245 (for engagement with the upper threaded portion 225 of the lower portion 205), and a through hole 235 along the longitudinal axis of the upper cap portion 210, which is sized and arranged so that an adjustment tool (e.g., an Allen wrench) may be passed there through to be inserted into a socket (not shown) of the lower portion (not shown). FIG. 7B also shows the lower surface 315 of the upper cap portion 210, which surface 315 contacts a tailpiece assembly (not shown) when the tailpiece assembly is arranged on the lower portion (not shown), and the upper cap portion 210 is attached to the lower portion.

FIG. 7C shows a top view of the upper cap portion 210 in accordance with aspects of the present disclosure. As shown in FIG. 7C, the upper cap portion 210 has a through hole 235 along the longitudinal axis of the upper cap portion 210, which is sized and arranged so that an adjustment tool (e.g., an Allen wrench) may be passed there through to be inserted into a socket (not shown) of the lower portion (not shown). As additionally shown in FIG. 7C, the head 250 of the upper cap portion 210 includes a slot 240. The slot 240 is configured to receive a tool (e.g., screwdriver) to rotatably engage (e.g., tighten or loosen) the upper cap portion 210 to the upper threaded portion of the lower portion (not shown).

FIG. 7D shows a further side view of the upper cap portion 210 in accordance with aspects of the present disclosure. As shown in FIG. 7D, the head 250 of the upper cap portion 210 includes a slot 240, which is configured to receive a tool (e.g., screwdriver) to rotatably engage (e.g., tighten or loosen) the upper cap portion 210 to the upper threaded portion of the lower portion (not shown).

While the specification has thus far described the mounting posts in the context of tailpieces, the inventors also contemplate the mounting posts can be used to mount other components to the stringed instrument. For example, similarly structured mounting posts may be used to mount a bridge on a guitar.

Figure 8A:
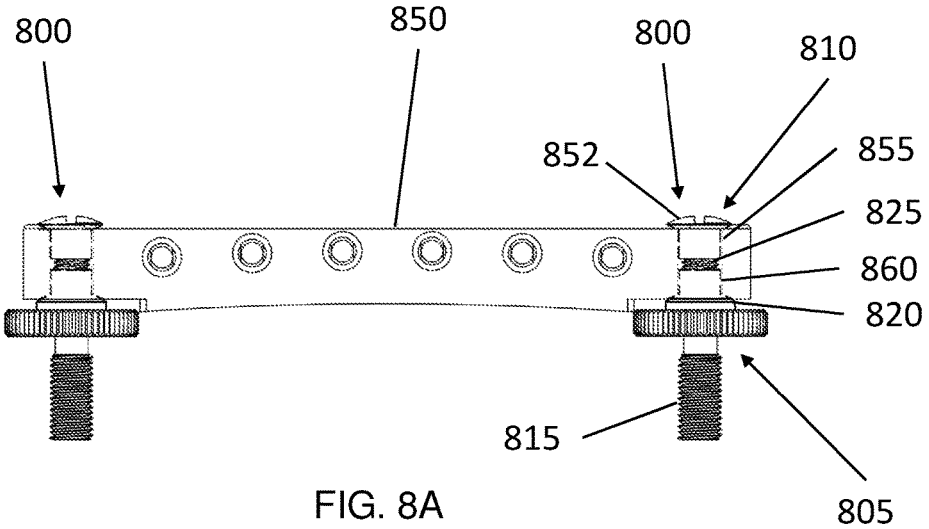
FIGS. 8A and 8B show exemplary depictions of a bridge mounted to a stringed-instrument body using two bridge stud assemblies in accordance with aspects of the disclosure.
Figure 8B:
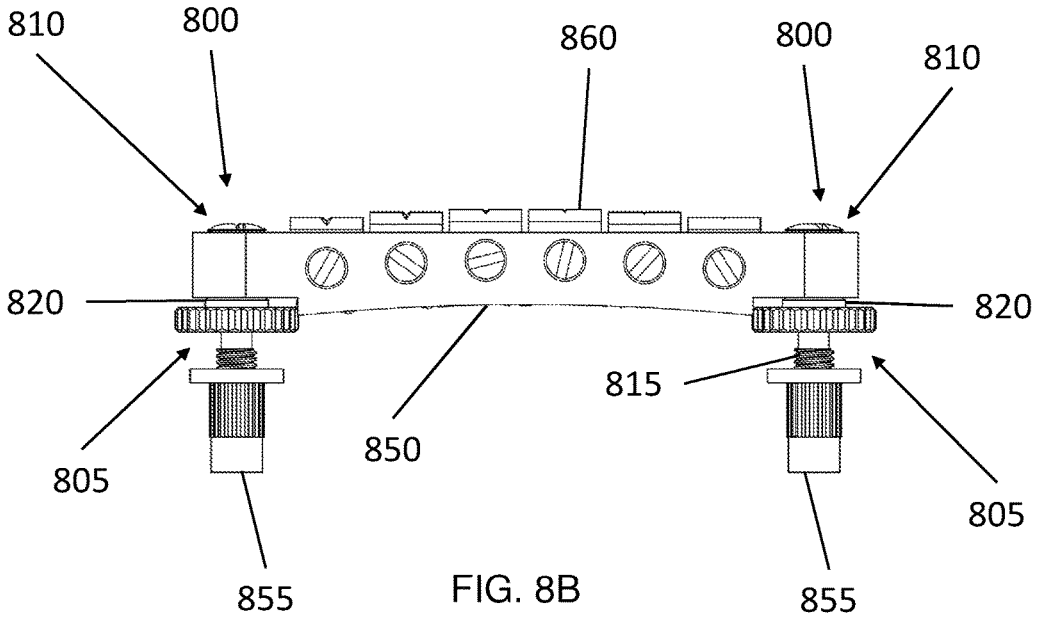

FIGS. 8A and 8B show exemplary depictions of a bridge mounted to a stringed-instrument body using two bridge stud assemblies 800 in accordance with aspects of the disclosure. As shown in FIGS. 8A and 8B, the bridge stud assembly 800 includes a lower portion 805 and an upper cap portion 810. As shown in FIGS. 8A and 8B, the lower portion 805 and the upper cap portion 810 are fastenable to one another to form the bridge stud assembly 800.

As shown in FIG. 8B, the lower portion 805 includes a lower threaded portion 815 configured to be threaded into the body of a musical instrument (e.g., guitar), for example directly or via a grommet 855. The lower portion 805 also includes a support platform 820 that is structured and arranged to support an end of a tailpiece 850 thereon. As shown in FIG. 8A, the lower portion 805 also includes a lower receiving shaft 860 and an upper threaded portion 825 extending from the lower receiving shaft 860. The upper threaded portion 825 has external threads structured and arranged for threaded engagement with a corresponding female internally threaded portion (not shown) of the upper portion 810. When assembled, the bridge stud assembly 800 provides a securing region for respective ends of a bridge 850. As is also shown in FIG. 8B, the bridge includes a plurality of saddles 860 structured and arranged to support respective individual strings (not shown).

In accordance with aspects of the disclosure, the lower portion 805 also includes a socket (e.g., a hex socket), which may be used to rotate (e.g., using a hex wrench or Allen wrench) the lower portion 805 so as to adjust the height of the lower portion 805 (or an extent of the threaded engagement of the lower portion 805 with the guitar). That is, instead of rotating the lower portion 805 by contacting an external surface of the support platform, with embodiments of the present disclosure, the lower portion 805 is rotatable by engaging a tool with an internal surface (e.g., the socket) of the lower portion 805. Thus, by implementing this aspect of the disclosure, a user can fasten the lower portion 805 to the guitar body without needing to contact (e.g., with a tool) the external surfaces of the lower portion 805 of the stud assembly 800. As such, damage to the lower portion 805 (e.g., to the surface or finish) can be avoided when initially installing the lower portion 805 to the instrument body.

As further shown in FIGS. 8A and 8B, the upper cap portion 810 includes an upper receiving shaft 855 and a head 852. The shaft 855 includes the internally threaded portion (not shown) that is engagable with the upper threaded portion 825 of the lower portion 805. In accordance with aspects of the disclosure, the head 852 of the upper cap portion 810 includes a through-hole (not shown) and a slot 840. The slot 840 is configured to receive a tool (e.g., screwdriver) to rotatably engage (e.g., tighten or loosen) the upper cap portion 810 to the upper threaded portion 825 of the lower portion 805. When the upper cap portion 810 is fastened to the lower portion 805, the upper cap portion 810 is operable to secure an end of a bridge 850 arranged on the support platform 820 to the instrument by pinching the end of the tailpiece between the support platform 820 and the head 852 of the upper cap portion 810.

In accordance with further aspects of the disclosure, when the upper cap portion 810 is fastened to the lower portion 805, the through-hole allows access through the upper cap portion 810 to the socket of the lower portion 805. Accordingly, even when the upper cap portion 810 is fastened to the lower portion 805, the socket is accessible so as to allow a user to make height adjustments to the lower portion 805 (and thus, height adjustments to the stud assembly 800 and the bridge assembly 800 arranged thereon. Accordingly, by implementing aspects of the disclosure, adjustments to the height at either end (or both ends) of the bridge may be made without risking damage to external surfaces of the bridge 850 or the stud assembly 800. Moreover, as access to the height adjustment with the embodiments of the present disclosure is via the top of the stud assembly, arranging a tool to make such adjustments is much easier than with conventional approaches that require access from a side of the stud.

As shown in the assembled view of FIG. 8A, when fastened to one another, a securing region is formed along the lower receiving shaft 860 and the upper receiving shaft 855 between the support platform 820 of the lower portion 805 and the head 850 of the upper cap portion 810. The height of the securing region may be structured so as to correspond with an approximate height of the bridge 850, so that a tightening of the upper cap portion 810 to the lower portion 805 "pinches" the bridge, thus securing the bridge 850 to the stud assembly 800. Additionally, in embodiments, the outer diameters of the lower receiving shaft 860 and the upper receiving shaft 855 are approximately equal to one another, and correspond with an internal diameter of a hole on the bridge 850 so as to minimize any longitudinal and/or lateral movement of the bridge 850 attached to the respective stud assemblies 800 in accordance with aspects of the disclosure. In further embodiments, the outer diameter of the lower receiving shaft 860 may be smaller than the outer diameter of the upper receiving shaft 855. In one exemplary and non-limiting embodiment, the outer diameter of the lower receiving shaft is 0.263" and the outer diameter of the upper receiving shaft is 0.280".

In accordance with further aspects of the disclosure, by utilizing the bridge stud assembly 800 having the locking upper cap portion 810, the bridge 850 can be secured to the guitar body, such that when the strings are not passing over the bridge (e.g., when changing strings), the bridge 850 remains attached to the guitar body.

Figure 9A:
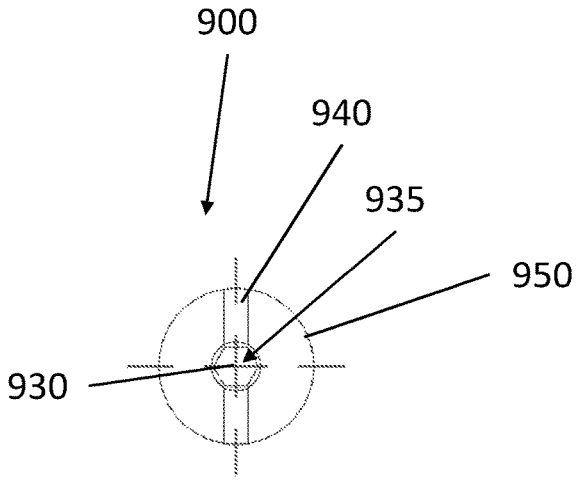
FIGS. 9A-9C show various views of a further embodiment of the stud assembly in accordance with aspects of the present disclosure.
Figure 9B:
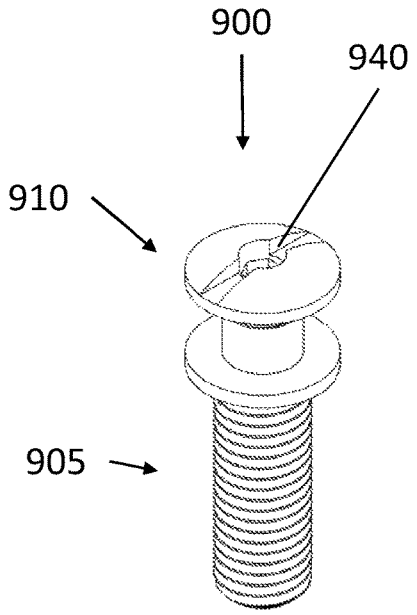
Figure 9C:
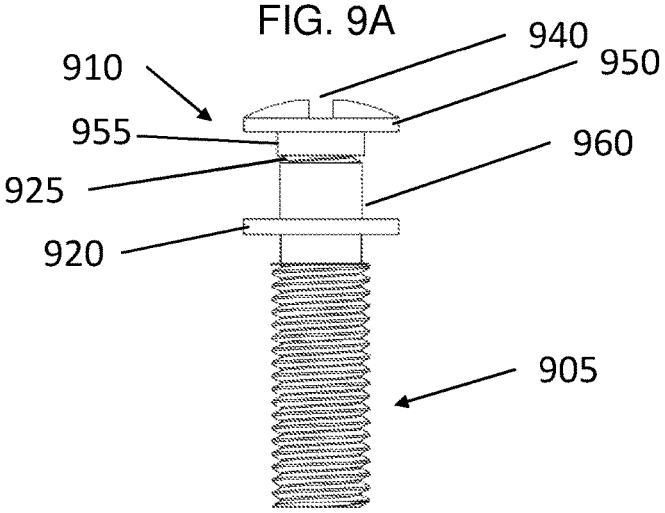

FIGS. 9A-9C show various views of a further embodiment of the stud assembly 900 in accordance with aspects of the present disclosure. As shown in FIGS. 9A-9C, with stud assembly 900, the head 950 of the upper cap portion 910 has a rounded low-profile shape, in contrast to the embodiments of FIGS. 7A-7D, which have a larger and more cylindrically shaped head. In accordance with aspects of the disclosure, by providing the stud assembly 900 with a rounded low-profile upper cap portion 910, the overall height of stud assembly 900 is lowered, and the upper cap portion 910 protrudes to a lesser extent above the tailpiece (or bridge, for example, as shown in FIG. 8B).

As shown in FIGS. 9A-9C, the upper cap portion 910 can be rotated (e.g. using the slot 940) relative to the lower portion 905 to remove the upper cap portion 910 therefrom and/or to adjust a height of the securing region. For example, different tailpieces may have different heights, and the tailpiece stud assembly 900 is adjustable so as to accommodate a range of different tailpiece heights in accordance with aspects of the disclosure. FIG. 9A shows a top view of the tailpiece stud assembly 900. As shown in FIG. 9A, the upper cap portion 910 includes a through-hole 935 therein, which provides a user access through the upper cap portion 910 to the socket 930 of the lower portion 905. Accordingly, even when the upper cap portion 910 is fastened to the lower portion 905, the socket 930 is accessible so as to allow a user to make height adjustments to the lower portion 905 (and thus, height adjustments to the stud assembly 900 and the tailpiece (not shown) arranged thereon). Accordingly, by implementing aspects of the disclosure, adjustments to the height of the tailpiece may be made without risking damage to external surfaces of the tailpiece or the stud assembly 900. Moreover, as access to the height adjustment with the embodiments of the present disclosure is via the top of the stud assembly 900 as shown in 9B, arranging a tool to make such adjustments is much easier than with conventional approaches that require access from a side of the stud to an external surface of the support platform 920. FIGS. 9A-9C also shows the slot 940, which is configured to receive a tool (e.g., screwdriver or a coin) to rotatably engage (e.g., tighten or loosen) the upper cap portion 910 to the upper threaded portion 925.

FIGS. 10A-10D show various views of a further embodiment of the upper cap portion of a stud assembly in accordance with aspects of the present disclosure. As shown in FIGS. 10A-10D, with stud assembly 900, the head 950 of the upper cap portion 910 has a rounded low-profile, in contrast to the embodiments of FIGS. 7A-7D, which have a larger and more cylindrical head.

Figure 10A:
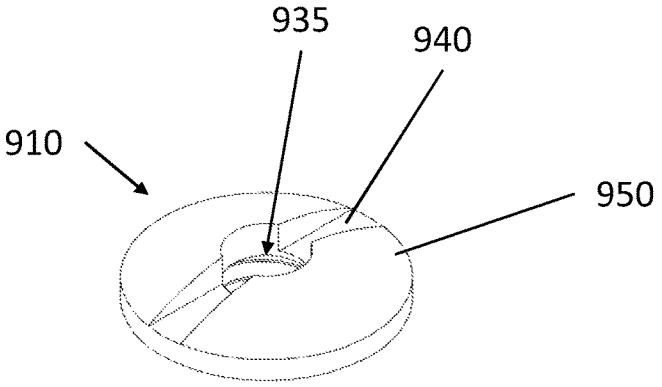
FIGS. 10A-10D show various views of a further embodiment of the upper cap portion of a stud assembly in accordance with aspects of the present disclosure.
Figure 10B:
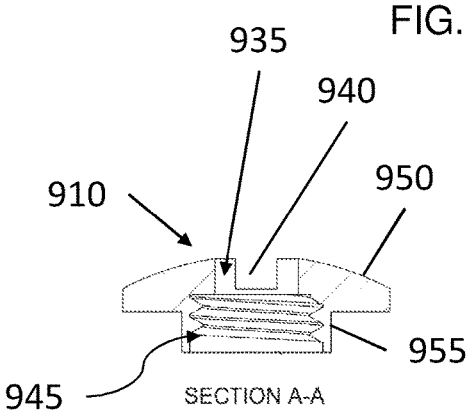
Figure 10C:
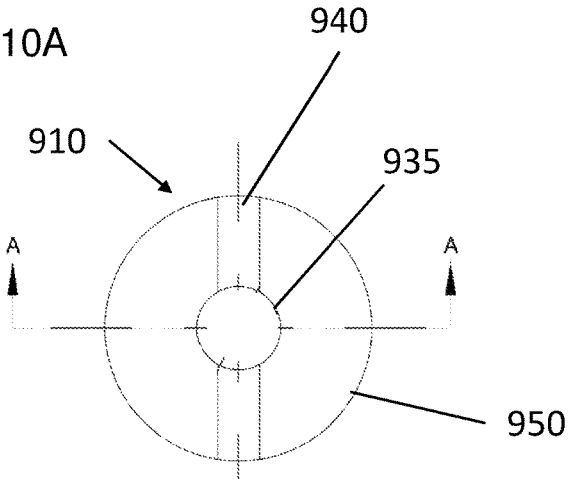
Figure 10D:
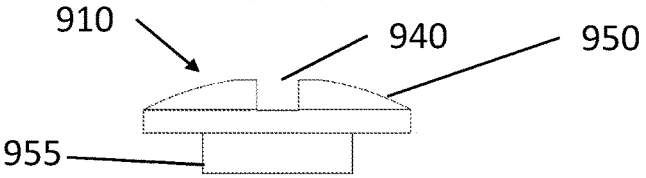

As further shown in FIGS. 10A-10D, the upper cap portion 910 includes an upper receiving shaft 955 and a head 950. As shown in FIG. 10B, the shaft 955 includes the internally threaded portion 945 that is engagable with the upper threaded portion (not shown). In accordance with aspects of the disclosure, the head 950 of the upper cap portion 910 includes a through-hole 935 and a slot 940. The slot 940 is configured to receive a tool (e.g., screwdriver) to rotatably engage (e.g., tighten or loosen) the upper cap portion 910 to the upper threaded portion 925 of the lower portion (not shown). When the upper cap portion 910 is fastened to the lower portion, the upper cap portion 910 is operable to secure an end of a tailpiece (not shown) arranged on the support platform (not shown) to the instrument by pinching the end of the tailpiece between the support platform (not shown) and the head 950 of the upper cap portion 910.

With an exemplary and non-limiting embodiment, the securing region formed along the lower receiving shaft has a diameter of 0.263" and a height of 0.180", and the support portion has a diameter of 0.500".

The components described herein are also designed to fit or retrofit most instruments without any modification to the original instrument. Even expensive "vintage" instruments can be fitted with the new components without any modification to the instrument, and the use of the new components does not detract from the "vintage" look of the instrument. The new components may be constructed to make visual detection of any difference between original stock components and the new components difficult. The new components are easy to use, install, and adjust by a purchaser. A professional installation and adjustment of the components is likely not needed after the first such installation and adjustment, as the instrument owner or user can perform the installation and maintenance.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure has been described with reference to specific embodiments, those skilled in the art will understand that various changes may be made and equivalents may be substituted for elements thereof without departing from the true spirit and scope of the disclosure. While exemplary embodiments are described above, it is not intended that these embodiments describe all possible forms of the embodiments of the disclosure. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

While the specification describes particular embodiments of the present disclosure, those of ordinary skill can devise variations of the present disclosure without departing from the inventive concept. For example, while the disclosure describes the mounting posts in the context of guitars, the inventors contemplate that the mounting posts may be utilized on a myriad of stringed instruments, including, for example and without limitation, bass guitars, mandolins, and dobroes.

Insofar as the description above and the accompanying drawing disclose any additional subject matter that is not within the scope of the claims below, the embodiments are not dedicated to the public and the right to file one or more applications to claim such additional embodiments is reserved.

What is claimed is:

1. A component mounting stud assembly, comprising:

a lower portion having an upper externally-threaded portion and a socket;

an upper cap portion having an internally-threaded portion configured for engagement with the upper externally-threaded portion, and a through-hole structured and arranged to provide access through the upper cap portion to the socket when the upper cap portion is attached to the lower portion.

2. The component mounting stud assembly according to claim 1, wherein the lower portion further comprises a lower threaded portion configured for threaded engagement with a stringed instrument.

3. The component mounting stud assembly according to claim 1, wherein the lower portion further comprises a support platform configured for supporting a component.

4. The component mounting stud assembly according to claim 3, wherein the component comprises a tailpiece.

5. The component mounting stud assembly according to claim 3, wherein the component comprises a bridge assembly.

6. The component mounting stud assembly according to claim 3, wherein the lower portion further comprises a lower receiving shaft arranged between the support platform and the upper externally-threaded portion.

7. The component mounting stud assembly according to claim 1, wherein the upper cap portion further comprises an upper receiving shaft and a head, wherein the through-hole passes through the upper receiving shaft and the head.

8. The component mounting stud assembly according to claim 7, wherein the upper cap portion further comprises a slot structured and arranged for receiving a slotted adjustment tool.

9. The component mounting stud assembly according to claim 1, wherein the upper cap portion and the lower portion are operable to secure an end of a component between respective surfaces of the upper cap portion and the lower portion.

10. The component mounting stud assembly according to claim 1, wherein a longitudinal axis of the through-hole is along a longitudinal axis of the component mounting stud assembly.

11. The component mounting stud assembly according to claim 1, wherein:

the lower portion further comprises a lower receiving shaft, and the upper cap portion further comprises an upper receiving shaft, the lower receiving shaft and the upper receiving shaft have an approximately equal diameter, and the lower receiving shaft and the upper receiving shaft together form a securing region for a component.

12. The component mounting stud assembly according to claim 1, wherein the lower portion further comprises a support platform having a support surface configured for supporting a component; and wherein the upper cap portion further comprises a head having a lower surface configured to contact the component when the upper cap portion is attached to the lower portion, so as to securely attach the component to the component mounting stud assembly.

13. The component mounting stud assembly according to claim 1, wherein the lower portion is configured for threaded engagement with a stringed instrument, and wherein the upper cap portion and the lower portion are configured to pinch a stringed-instrument component there between such that the component is securely fastenable to the stringed instrument.

14. A tailpiece assembly, comprising:

a tailpiece having a mounting slot or hole at respective longitudinal end regions of the tailpiece; and a component mounting stud assembly according to claim 1 secured to each mounting slot or hole.

15. A stringed instrument, comprising:

two instrument mounting holes; and the tailpiece assembly of claim 14, wherein the respective lower portions further comprise a lower threaded portion configured for respective threaded engagement with the two instrument mounting holes.

16. A bridge assembly, comprising a bridge having a mounting hole at respective longitudinal end regions of the bridge; and a component mounting stud assembly according to claim 1 secured to each mounting hole.

17. A stringed instrument, comprising:

two instrument mounting holes; and the bridge assembly of claim 16, wherein the respective lower portions further comprise a lower threaded portion configured for respective threaded engagement with the two instrument mounting holes.

18. A method of adjusting a component mounting stud assembly, the stud assembly comprising a lower portion having an upper externally-threaded portion and a socket, an upper cap portion having an internally-threaded portion configured for engagement with the upper externally-threaded portion, and a through-hole structured and arranged to provide access through the upper cap portion to the socket when the upper cap portion is attached to the lower portion, the method comprising:

passing an adjustment tool through the through-hole of the upper cap portion and into engagement with the socket of the lower portion; and rotating the adjustment tool to rotate the lower portion so as to adjust a height of the component mounting stud assembly.

19. A component mounting stud assembly, comprising:

a lower portion having:

an upper externally-threaded portion;

a socket;

a lower threaded portion configured for threaded engagement with a stringed instrument;

a support platform configured for supporting a component; and a lower receiving shaft arranged between the support platform and the upper externally-threaded portion, an upper cap portion having:

an internally-threaded portion configured for engagement with the upper externally-threaded portion;

a through-hole structured and arranged to provide access through the upper cap portion to the socket when the upper cap portion is attached to the lower portion;

an upper receiving shaft; and a head, wherein the through-hole passes through the upper receiving shaft and the head, and wherein a longitudinal axis of the through-hole is along a longitudinal axis of the component mounting stud assembly, wherein the lower receiving shaft and the upper receiving shaft together form a securing region for a component, and wherein the upper cap portion and the lower portion are operable to secure an end of the component between respective surfaces of the upper cap portion and the lower portion.

20. The component mounting stud assembly according to claim 19, wherein the component comprises a tailpiece or a bridge assembly.

* * * * *